US007776932B2

(12) United States Patent
Marion et al.

(10) Patent No.: US 7,776,932 B2
(45) Date of Patent: Aug. 17, 2010

(54) FISCHER-TROPSCH SYNTHESIS PROCESS WITH IMPROVED REGULATION

(75) Inventors: Marie-Claire Marion, Vernaison (FR); Eric Lemajre, Anse (FR); Jean-Marc Schweitzer, Villette de Vienne (FR)

(73) Assignees: Institut Francais du Petrole, Rueil Malmaison Cedex (FR); ENI S.p.A., Rome (IT)

( * ) Notice: Subject to any disclaimer, the term of this patent is extended or adjusted under 35 U.S.C. 154(b) by 527 days.

(21) Appl. No.: 11/596,848

(22) PCT Filed: May 17, 2005

(86) PCT No.: PCT/FR2005/001234

§ 371 (c)(1),
(2), (4) Date: Jan. 7, 2008

(87) PCT Pub. No.: WO2005/123882

PCT Pub. Date: Dec. 29, 2005

(65) Prior Publication Data

US 2008/0200569 A1 Aug. 21, 2008

(30) Foreign Application Priority Data

May 19, 2004 (FR) ..... 04 05551

(51) Int. Cl.
*C07C 27/00* (2006.01)

(52) U.S. Cl. ..... 518/705; 518/700; 518/715; 518/719

(58) Field of Classification Search ..... 518/700, 518/705, 715, 719
See application file for complete search history.

(56) References Cited

U.S. PATENT DOCUMENTS

| | | | | |
|---|---|---|---|---|
| 5,023,276 | A * | 6/1991 | Yarrington et al. | 518/703 |
| 6,784,212 | B2 | 8/2004 | Steynberg | |
| 2004/0014825 | A1 | 1/2004 | Hensman | |

FOREIGN PATENT DOCUMENTS

| | | |
|---|---|---|
| WO | WO 0238699 A | 5/2002 |

* cited by examiner

*Primary Examiner*—Jafar Parsa
(74) *Attorney, Agent, or Firm*—Millen, White, Zelano, Branigan, P.C.

(57) ABSTRACT

A process for the production of liquid hydrocarbons by the Fischer-Tropsch process comprises a step a) for generating a synthesis gas, a step b) for Fischer-Tropsch synthesis, a step c) for condensing the gaseous effluent obtained during step b), a step d) for separating the effluent condensed during step c) to obtain a gaseous effluent enriched in carbon monoxide and hydrogen, and a step e) for recycling at least a portion of the enriched gaseous effluent obtained during step d) to the Fischer-Tropsch synthesis step b), characterized in that:

1) two molar ratio of concentrations, A1 and A2, are determined between the hydrogen and the carbon monoxide ($H_2$/Co), A1 being the value of said ratio in the supply to the synthesis step b), and A2 being the value of said ratio in any one of the gaseous effluents obtained during steps b) to e);
2) comparing ratios A1 and A2; and
3) adjusting the concentrations of hydrogen and/or carbon monoxide in the synthesis gas to keep the difference between the two ratios A1 and A2 substantially constant.

12 Claims, 5 Drawing Sheets

FISCHER-TROPSCH SYNTHESIS PROCESS WITH IMPROVED REGULATION

FIELD OF THE INVENTION

The invention relates to the field of processes for producing liquid hydrocarbons comprising a Fischer-Tropsch synthesis step. More particularly, It relates to an improved Fischer-Tropsch synthesis process that can maximize production and minimize production costs.

PRIOR ART

The synthesis of hydrocarbons from a mixture constituted by carbon monoxide and hydrogen, commonly known as synthesis gas, has long been known.

In particular, the work of F Fischer and H Tropsch can be cited; in 1923, they gave their names to this chemical transformation, which is well known as the Fischer-Tropsch synthesis. Fischer-Tropsch synthesis is a reaction for synthesizing liquid hydrocarbons which are paraffins, olefins and/or oxygenated derivatives from a synthesis gas, this latter being obtained from natural gas or coal, for example. Between 1980 and 1990, that reaction, which was used industrially in Europe during World War II and which has also been used in South Africa since the 1950s, came back into favour with a vengeance following the oil and gas price rises and also for environmental reasons.

One of the preoccupations of the skilled person in developing such processes is to maximize the degree of conversion of the reactants, i.e. to maximize the degree of conversion of carbon monoxide into liquid hydrocarbons. It is often difficult to maximize the degree of conversion of reagents in a single reactor and in a single pass, i.e. in a single passage of said reagents in said reactor. Seeking a high degree of conversion can degrade the function of the catalyst employed during synthesis because of the operating conditions used, in particular the high partial pressures for water. As an example, a substantial reduction in the selectivity for products containing at least five carbon atoms is observed when, using a cobalt-based catalyst, the degree of conversion of the carbon monoxide is pushed beyond about 80% by weight.

To maximize conversion of carbon monoxide during the Fischer-Tropsch synthesis, a solution may consist of carrying out that synthesis in a plurality of steps, for example using several reactors in series. A further solution is to carry out the Fischer-Tropsch synthesis in a single reactor using an internal recycle around said reactor, which keeps the degree of conversion per pass to a moderate level, for example of the order of 60% to 70% by weight, while achieving a high overall degree of conversion, for example 90% conversion or more.

International patent application WO-A-02/38699 describes a process for producing liquid hydrocarbons by the Fischer-Tropsch process, comprising at least the following steps:

- a step a) for generating a synthesis gas essentially comprising carbon monoxide and hydrogen;
- a step b) for Fischer-Tropsch synthesis starting from a supply comprising at least a portion of the synthesis gas, to produce an effluent comprising synthesized liquid hydrocarbons and at least one gaseous effluent;
- a step c) for condensing the gaseous effluent obtained during step b);
- a step d) for separating the effluent condensed during step c) to obtain a gaseous effluent enriched in carbon monoxide and hydrogen, an aqueous phase and liquid hydrocarbons; and

- a step e) for recycling at least a portion of the enriched gaseous effluent obtained during step d) to the Fischer-Tropsch synthesis step b).

In that type of process, the application ratio is generally described as the stoichiometric ratio (or mole ratio) between the hydrogen and the carbon monoxide consumed by the Fischer-Tropsch synthesis. The application ratio is generally variable. This ratio may depend on the nature of the catalyst and on the operating conditions employed during synthesis. This application ratio can change with time as a function, for example, of the stability of the catalyst. This application ratio can also reflect the selectivity of the catalyst. As an example, in the case of a Fischer-Tropsch process using a catalyst based on cobalt and intended to produce long chain paraffinic hydrocarbons, the application ratio may be between 2.0 and 2.3 by moles.

Further, the ratio between hydrogen and carbon monoxide introduced into a reaction zone in which the Fischer-Tropsch synthesis is carried out acts on the reaction mechanisms for said synthesis, in particular on the kinetics and selectivity of the catalyst employed.

Thus, it is important for the skilled person to be able to control the ratio between the hydrogen and the carbon monoxide introduced into the reaction zone in which the Fischer-Tropsch synthesis is carried out.

DETAILED DESCRIPTION OF THE INVENTION

In a first aspect, then, the invention concerns a process for the production of liquid hydrocarbons by the Fischer-Tropsch process comprising a step a) for generating a synthesis gas essentially comprising carbon monoxide and hydrogen, a step b) for Fischer-Tropsch synthesis starting from a supply comprising at least a portion of the synthesis gas, to produce an effluent comprising synthesized liquid hydrocarbons and at least one gaseous effluent, a step c) for condensing the gaseous effluent obtained during step b), a step d) for separating the effluent condensed during step c) to obtain a gaseous effluent enriched in carbon monoxide and hydrogen, an aqueous phase and liquid hydrocarbons, and a step e) for recycling at least a portion of the enriched gaseous effluent obtained during step d) to the Fischer-Tropsch synthesis step b), in which:

1) two molar ratio of concentrations A1, and A2, are determined between the hydrogen and the carbon monoxide ($H_2$/CO), A1 being the value of said ratio in the supply to the synthesis step b), and A2 being the value of said ratio in any of the gaseous effluents obtained during steps b) to e);

2) comparing ratios A1 and A2; and 3) adjusting the concentrations of hydrogen and/or carbon monoxide in the synthesis gas to keep the difference between the two ratios A1 and A2 substantially constant.

The term "to keep the difference between A1 and A2 substantially constant" in general provides a margin for error with respect to the desired difference between A1 and A2. This margin for error is a function of the regulation system employed and the response times of the adjustment means. Said margin for error is plus or minus 5% or less, preferably plus or minus 2% or less, more preferably plus or minus 1% or less, for example plus or minus 0.5% or less.

The molar concentrations of hydrogen and carbon monoxide may be determined using any means known to the skilled person, such as chromatographic analyses. Said ratio of concentrations A1 and A2 may then be determined by simple calculation from the concentration measurements.

A1 corresponds to a mole ratio of concentrations of hydrogen and carbon monoxide in the supply to step b) of the Fischer-Tropsch synthesis. This supply is generally a mixture comprising synthesis gas produced in step a) and the hydrogen and carbon monoxide-rich effluent recycled during step e).

A2 corresponds to a mole ratio of concentrations of hydrogen and carbon monoxide in any one of the gaseous effluents obtained during steps b) to e). Generally, A2 is calculated from measurements carried out in any gaseous effluent derived from the gaseous effluent obtained during step b) and orientated towards the effluent recycled during step e). These streams generally have hydrogen and carbon monoxide concentrations in the same proportions.

More precisely, the ratio of concentrations A2 may be calculated on the basis of measurements carried out on at least one of the following effluents:

- the gaseous effluent obtained during step b);
- the cooled effluent obtained during step c), preferably the gaseous portion of said effluent;
- the carbon monoxide- and hydrogen-enriched gaseous effluent obtained during step d); or
- the effluent recycled to Fischer-Tropsch synthesis step b).

According to the invention, after comparing A1 and A2, the concentrations of hydrogen and/or carbon monoxide in the synthesis gas obtained in step a) are adjusted to keep the difference between the two ratios A1 and A2 substantially constant.

This adjustment may be carried out using any means that is known to the skilled person, such as a regulation system or a controller connected to means for measuring the concentrations of hydrogen and carbon monoxide used to calculate the ratios A1 and A2, and to means for adjusting the concentrations of hydrogen and/or carbon monoxide in the synthesis gas obtained in step a).

In the particular case in which the difference between the two ratios A1 and A2 are to be minimized, when a perturbation, a transitional phase or start-up causes the ratio of concentrations A1 to be less than the ratio of concentrations A2, regulation of the process of the invention instigates adjustments in step a) of the process to enrich the synthesis gas in carbon monoxide or to deplete it in hydrogen to minimize or keep constant the difference between A1 and A2. In contrast, if the ratio of concentrations A1 becomes greater than the ratio of concentrations A2, the regulation of the process of the invention instigates adjustments in step a) of the process to enrich the synthesis gas in hydrogen or to deplete it in carbon monoxide to equalize A1 and A2.

Implementation of the process of the invention can advantageously avoid having to carry out regulation with respect to a given value of the application ratio. In the context of the present invention, regulation is carried out by minimizing or keeping constant the difference between two ratio of concentrations, in this case those measured by A1 and A2.

Preferably, the concentrations of hydrogen and/or carbon monoxide in the synthesis gas obtained in step a) are adjusted to keep the difference between the two ratios A1 and A2 substantially constant.

Alternatively, the concentrations of hydrogen and/or carbon monoxide in the synthesis gas obtained in step a) may be adjusted to keep the difference between the two ratios A1 and A2 constant. In this case, the difference between the two ratios A1 and A2 is preferably kept to a constant value of less than 0.5, preferably less than 0.2. This mode allows adjustment of the selectivity of the reaction to obtain the desired product distribution. As an example, ageing of the catalyst over time may induce a variation in the application ratio, giving rise to a modification in the product distribution. Thus, to maintain the product distribution, it may be advantageous to keep constant the difference between the two ratios A1 and A2, the constant value being less than 0.5, preferably less than 0.2.

The application ratio in the reaction zone for the Fischer-Tropsch synthesis step b) may vary over time. As an example, this application ratio has a tendency to increase over time, which may result in some deactivation of the catalyst, and more particularly a reduction in its selectivity for long chain hydrocarbon products. Similarly, the application ratio may increase with temperature, which encourages the formation of light products to the detriment of heavy products. Thus, any change in capacity, in terms of modifying the space velocity and/or modifying the operating temperature, may have an impact on the application ratio in the Fischer-Tropsch synthesis reaction zone.

Preferably, the process of the invention is carried out so as to regulate the operating conditions to adjust the $H_2$/CO ratio of concentrations to a level corresponding to a required application ratio which is in concordance with an envisaged product distribution.

The present invention may advantageously be implemented in processes for converting natural gas to liquid hydrocarbons, known as gas to liquid or GTL processes. These processes can upgrade natural gas which, inter alia, can produce very high quality, sulphur-free diesel fuel from natural gas. Said processes generally employ a catalyst based on cobalt or iron, preferably based on cobalt.

Step a)

The process of the invention thus comprises a step a) for generating synthesis gas essentially comprising carbon monoxide and hydrogen.

Said generation of a synthesis gas may be carried out from natural gas, coal, or it may be obtained by any other transformation route known to the skilled person, for example by decomposing methanol in the presence of a copper-based catalyst. Preferably, the synthesis gas is generated from natural gas.

When step a) for generating a synthesis gas is carried out by conversion of natural gas, said step a) may comprise a step for steam reforming methane or a step for partially oxidizing methane, or a combination of these two steps, such as the autothermal reforming process, for example the ATR© process marketed by TOPSOE.

This first step may comprise a combination of a step for steam reforming methane with a step for partial oxidation of methane. In addition to its energetic advantage, since it combines an endothermic reaction with an exothermic reaction which overall endows it with a certain energetic autonomy, this implementation provides a means for adjusting the concentrations of hydrogen and carbon monoxide in the synthesis gas, in particular the ratio of concentrations of hydrogen and carbon monoxide, $H_2$/CO. This is generally the case when carrying out a reaction for converting carbon monoxide in the presence of water to carbon dioxide and hydrogen.

Step a) for generating a synthesis gas may comprise means for adjusting the concentrations of hydrogen and/or carbon monoxide in the synthesis gas. As an example, said means may be means for injecting water and/or carbon dioxide at a controlled rate. In the case in which step a) comprises autothermal reforming, injecting water vapour at a controlled rate is particularly suitable.

In a preferred mode of the process of the invention, step a) for generating a synthesis gas is followed by a step a') for adjusting the concentrations of hydrogen and/or carbon monoxide in the synthesis gas.

This step a') may be carried out starting from a supply for all or part of the synthesis gas produced in step a). Preferably, step a') is carried out starting from a supply of a portion of the synthesis gas produced in step a), of 1% to 50% by weight, preferably 10% to 30% by weight of the synthesis gas produced in step a).

Preferably, said step a') may comprise using a means for extracting hydrogen or carbon monoxide, such as a membrane which preferentially extracts hydrogen from a mixture comprising hydrogen and carbon monoxide.

Said step a') may comprise using means for adding hydrogen or carbon monoxide, such as a hydrogen makeup line from a neighbouring catalytic reforming unit.

The means for adjusting the concentrations of hydrogen and/or carbon monoxide in the synthesis gas, which are inseparable from step a) for generating synthesis gas or which are separate and integrated into a step a') separate from step a), can thus modify the composition, in particular the concentrations of hydrogen and/or carbon monoxide, of the synthesis gas produced during step a). Said adjustment may also be carried out using the regulation system which constitutes one of the aspects of the invention.

Thus, the ratio of molar concentrations $H_2/CO$ of the supply to the reaction section of step b) is adjusted, advantageously to a level which is substantially equal to the application ratio of the reaction occurring in said reaction section.

In the case in which the adjustment means are separate and integrated into a step a') separate from step a), the ratio of concentrations $H_2/CO$ at the outlet from step a') may be equal to, greater than or lower than the ratio of concentrations $H_2/CO$ in the synthesis gas from step a).

In this same case, step a') may improve regulation of the ratio of concentrations $H_2/CO$ for the supply to the reaction section of step b). In fact, even if it is often possible to carry out an adjustment of this ratio of concentrations $H_2/CO$ directly during step a) for generating synthesis gas, the actions of regulation on said step a) may have a substantial response time which may prove to be too slow for establishing effective regulation, or even may be incompatible with the regulation system of the present invention. The preferred implementation using a step a') provides the process of the invention with flexibility. The adjustments made in step a') are simple and rapid corrective actions which considerably improve the overall performance of the process of the invention.

Step b):

Fischer-Tropsch synthesis step b) of the process of the invention is carried out starting from a supply comprising at least a portion of the synthesis gas from steps a) or a') and allowing the production of an effluent comprising liquid synthesized hydrocarbons and at least one gaseous effluent.

By dint of the system from regulating the ratio of concentrations $H_2/CO$ in step b), the function of this Fischer-Tropsch synthesis step is optimized.

Fischer-Tropsch synthesis step b) is carried out in a reaction zone comprising one or more suitable reactors, the technology of which is known to the skilled person. As an example, it may concern multitubular fixed bed reactors, moving bed reactors or slurry bubble column reactors (SBC reactors).

In accordance with a preferred mode of the invention, step b) employs one or more slurry bubble column reactors. Since synthesis is highly exothermic, this mode can, inter alia, improve thermal control of the reactor, in particular in the case of high capacity units.

The catalyst employed in said step b) is generally any catalytic solid known to the skilled person for carrying out the Fischer-Tropsch synthesis. Preferably, the catalyst employed in said step b) comprises cobalt or iron, preferably cobalt.

The catalyst employed in said step b) is generally a supported catalyst. As an example, the support may be based on alumina, silica or titanium.

The temperature and pressure conditions are variable and adapted to the catalyst employed in said step b). The pressure may generally be in the range 0.1 to 10 MPa. The temperature may generally be in the range 200° C. to 400° C.

When the catalyst employed in step b) is based on cobalt, the temperature is preferably in the range from about 200° C. to 250° C. and the pressure is preferably in the range from about 1 to 4 MPa.

The supply to step b) of the invention comprises carbon monoxide and hydrogen with a molar ratio of concentrations $H_2/CO$ which may be in the range 0.5 to 3, preferably in the range 1 to 2.5, and more preferably in the range 2.0 to 2.3.

The liquid effluent from step b) comprising synthesized liquid hydrocarbons is generally intended to be treated in various steps for purification and/or conversion to produce fuels, for example, in particular very high quality diesel fuel.

Step c):

According to the invention, during step c), a gaseous effluent obtained during step b) is condensed. Said effluent may comprise all or part of the effluent obtained during step b). Said condensation step may be carried out to achieve a temperature of −20° C. to 300° C., preferably 0° C. to 200° C., more preferably 30° C. to 60° C.

Preferably, condensation step c) is carried out to condense at least a portion of the effluent sent to said step, which can produce a two-phase stream. The condensed portion may represent at most 50%, preferably at most 15% by weight of the portion of the effluent sent to the condensation step.

Condensation step c) may be carried out using any means known to the skilled person, for example an air condenser or a conventional water heat exchanger, preferably an air condenser.

Step d)

According to the invention, during separation step d), the effluent condensed during step c) is sent to a separation zone to produce a gaseous effluent enriched in carbon monoxide and hydrogen, an aqueous phase and liquid hydrocarbons.

The separation zone in which separation step d) is carried out may be equipped with any means known to the skilled person, such as one or more separation drums.

Step e):

According to the invention, during step e), at least a portion of the gaseous effluent enriched in carbon monoxide and hydrogen obtained during step d) is sent to the Fischer-Tropsch synthesis step b).

The portion of the enriched gaseous effluent recycled to the Fischer-Tropsch synthesis step b) may comprise at least 50% by volume, preferably at least 75% by volume and more preferably at least 85% by volume of the effluent enriched in carbon monoxide and hydrogen obtained during step d).

The portion of the enriched effluent recycled to step b) may have a flow rate of 0 (excluded) to 2 times, preferably 0.5 to 1.5 times that of the synthesis gas from step a) or a').

Preferably, the portion of the effluent enriched in carbon monoxide and hydrogen is compressed using any means that is known to the skilled person to a pressure of 0.1 to 10 MPa, preferably 1 to 4 MPa and more preferably 2 to 3 MPa.

Preferably, recycle step e) comprises means for extracting carbon dioxide. Said means may be any means known to the skilled person, such as washing with an aqueous amine solution.

Carbon dioxide extraction may be partial or complete. Said extraction may be carried out on all or a portion of the recycled enriched effluent.

The recycled enriched effluent may optionally be reheated or chilled using any means known to the skilled person.

For a better understanding, three implementations of the process of the invention are illustrated in FIGS. 1, 2 and 3.

FIG. 1 diagrammatically shows an implementation corresponding to the basic version of the process of the invention.

FIG. 2 schematically shows a preferred implementation of the process of the invention in which a separate step a') for adjusting the ratio of the concentrations of hydrogen and carbon monoxide is carried out after step a) for generating synthesis gas.

FIG. 3 diagrammatically shows a further preferred implementation in which step a') for adjusting the ratio of the concentrations of hydrogen and carbon monoxide is carried out on only a portion of the synthesis gas produced during step a).

Figure 1:
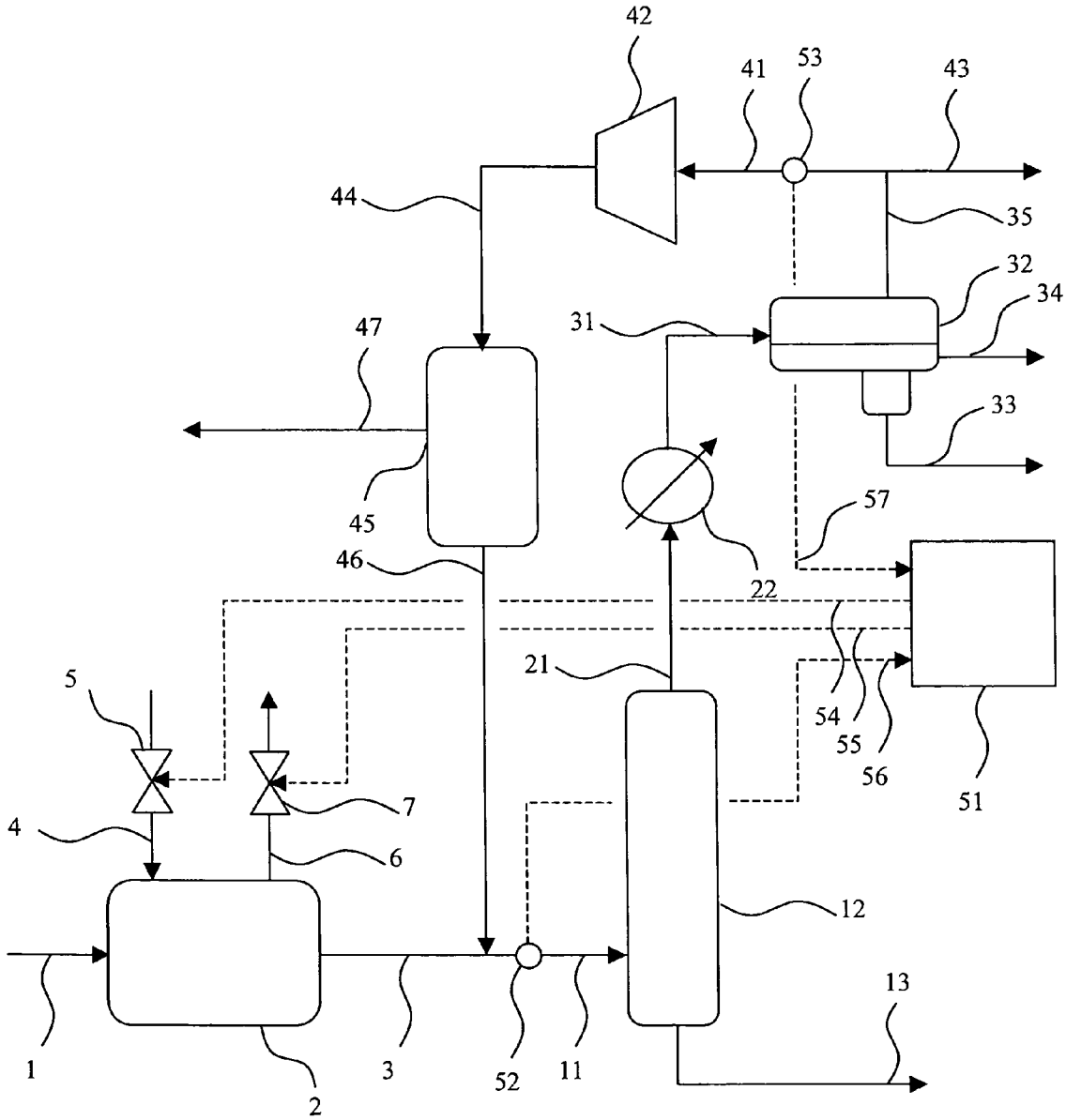
Figure 2:
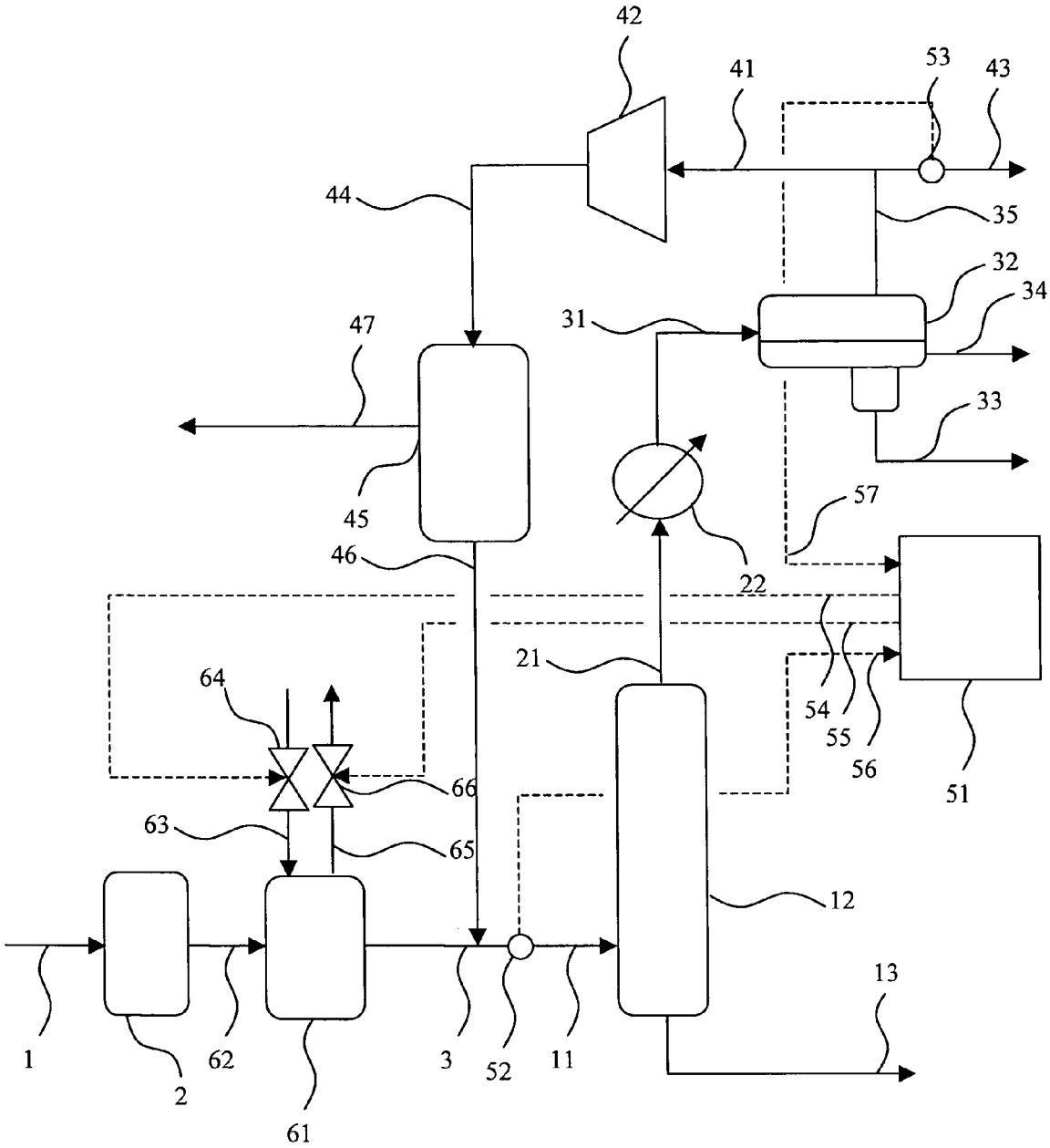
Figure 3:
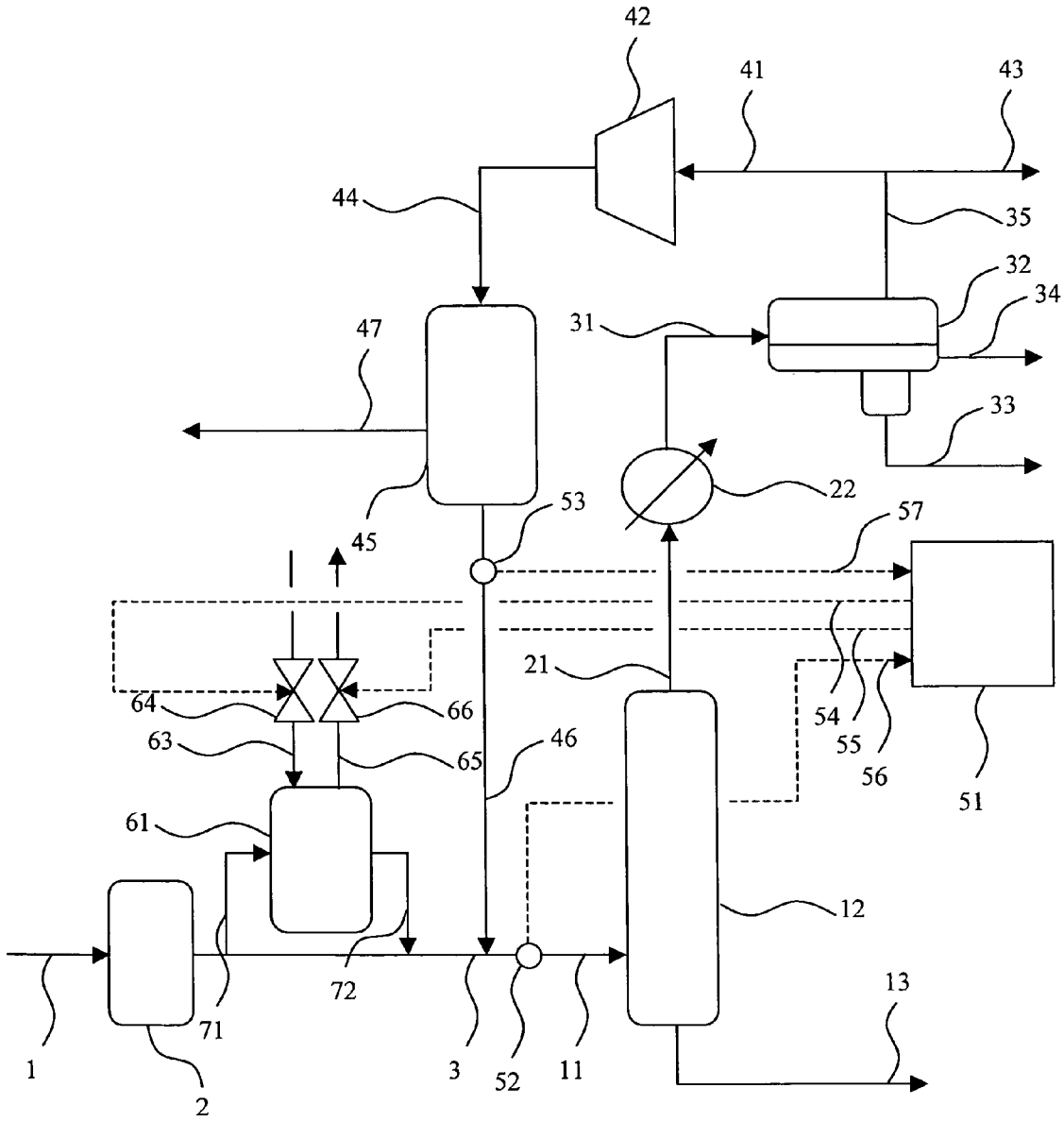

The implementations shown in FIGS. 1 to 3 are given by way of example and are not limiting in nature. These illustrations of the process of the invention do not include all of the components necessary for its implementation; only the elements needed to illustrate the invention are shown; the skilled person will be capable of completing the scheme in order to implement the invention.

DETAILED DESCRIPTION OF THE FIGURES

In FIG. 1, a hydrocarbon feed is sent via a line 1 to a zone for generating a synthesis gas 2, said gas then being sent to a line 3. The generation zone 2 is provided with means for adjusting the concentrations of hydrogen and carbon monoxide in the synthesis gas produced. Said means are shown diagrammatically by a hydrogen supply line 4 provided with a valve 5 and a hydrogen evacuation line 6 provided with a valve 7. The two valves 5 and 7 may be operated remotely by means of a programmable controller 51.

The synthesis gas is sent via a line 3 and a line 11 to a Fischer-Tropsch synthesis reactor 12. Said reactor is provided with a line 13 for evacuating an effluent comprising liquid hydrocarbons to purification and/or conversion steps which are not shown.

A gaseous effluent is also evacuated via a line 21 from the Fischer-Tropsch synthesis reactor 12. Said gaseous effluent is directed towards a chilling unit 22.

The chilled effluent is directed via a line 31 to separation means, in this case a separating drum 32. A water-enriched aqueous effluent is extracted from the bottom of the drum via a line 33. A hydrocarbon-enriched liquid effluent is also extracted via a line 34. An effluent enriched n carbon monoxide and hydrogen is evacuated overhead from the separator drum, via a line 35.

A portion of the enriched effluent is sent via a line 41 to a compressor 42. The other portion of the enriched effluent is evacuated via a line 43. After compression, the portion of the effluent which is enriched and compressed is sent via a line 44 to the means 45 for extracting carbon dioxide before being recycled to the Fischer-Tropsch synthesis reactor via a line 46 by a line 11. The carbon dioxide is extracted via a line 47.

A programmable controller 51 can regulate opening and closing of valves 5 and 7 as a function of measurements of the concentrations of hydrogen and carbon monoxide made using chromatographic analyzers 52 and 53 located on lines 11 and 41 respectively. Valves 5 and 7 and analyzers 52 and 53 are connected to the programmable controller via lines 54, 55, 56 and 57 respectively.

FIG. 2 comprises elements which have already been seen in FIG. 1. In addition to those elements, the implementation of FIG. 2 comprises means 61 for adjusting the ratio of concentrations of hydrogen and carbon monoxide in the synthesis gas, said means being separate from the zone 2 for generating synthesis gas. Said adjustment means are connected to the zone for generating a synthesis gas via a line 62.

The means (4, 5, 6 and 7) for adjusting the concentrations of hydrogen and carbon monoxide of FIG. 1 are replaced in FIG. 2 by a hydrogen supply line 63 provided with a valve 64 and a line 65 for evacuating hydrogen provided with a valve 66. The two valves 64 and 66 are operated remotely by a programmable controller.

The programmable controller 51 can regulate opening and closing of valves 64 and 66 as a function of measurements of the concentrations of hydrogen and carbon monoxide carried out using chromatographic analyzers 52 and 53 which, in this implementation, are located on lines 11 and 43 respectively. Valves 64 and 66, and analyzers 52 and 53 are connected to the programmable controller 51 via lines 54, 55, 56 and 57 respectively.

FIG. 3 shows the elements already shown in FIG. 2. It differs from the implementation of FIG. 2 in that the adjustment means 61 for the hydrogen and carbon monoxide ratio of concentrations in the synthesis gas are directly connected to the synthesis gas line 3 via a supply line 71 and an evacuation line 72.

Thus, the step for adjusting the ratio of the hydrogen and carbon monoxide concentrations is only carried out on a portion of the synthesis gas produced during step a).

In this implementation, the programmable controller 51 can regulate opening and closing of valves 64 and 66 as a function of measurements of the concentrations of hydrogen and carbon monoxide made using chromatographic analyzers 52 and 53 which in this case are located on lines 11 and 46 respectively. Valves 64 and 66 and analyzers 52 and 53 are connected to the programmable controller 51 via lines 54, 55, 56 and 57 respectively.

EXAMPLES

The flowchart of FIG. 3 forms the basis of the examples. The reaction section for Fischer-Tropsch synthesis used in these examples was supplied with a synthesis gas comprising hydrogen and carbon monoxide. This synthesis gas was produced by a generating device and an adjustment device allowing the ratio of concentrations $H_2/CO$ of hydrogen and carbon monoxide in said synthesis gas to be either kept constant or adjusted to a value determined by a programmable controller.

The recycle ratio, defined as the ratio of the flow rate in the recycle loop to the flow rate of the synthesis gas at the outlet from the synthesis gas generation zone, was kept to a value of about 1.0.

The Fischer-Tropsch synthesis reaction was carried out at 220° C. and 2 MPa in the presence of a solid cobalt-based catalyst. Under the conditions reigning in the reaction zone, the application ratio was about 2.10 and the initial degree of conversion per pass was 60% by weight.

In a first case, the Fischer-Tropsch reaction section was supplied with a synthesis gas having a $H_2$/CO molar ratio of concentrations of 2.0.

In a second case, the Fischer-Tropsch reaction section was supplied with a synthesis gas having a $H_2$/CO molar ratio of concentrations of 2.2.

In these first two cases, the process carried out was in accordance with the flowchart of FIG. 3, in which the regulation system of the invention (adjustment means 61, controller 51, valves 64 and 66) was not used (comparative cases).

In a third case (in accordance with the invention), the Fischer-Tropsch reaction section was supplied with a synthesis gas having a $H_2$/CO molar ratio of concentrations that was regulated using adjustment means 61, controller 51 and valves 64 and 66 of the invention (FIG. 3).

The performances obtained in these three cases are shown in Table 1 below.

TABLE 1

| | 1st case | 2nd case | 3rd case |
|---|---|---|---|
| H2/CO ratio in synthesis gas (3) | 2.0 | 2.2 | 2.0 |
| Initial $H_2$/CO ratio in supply to Fischer-Tropsch reaction zone (11) | 2.0 | 2.2 | 2.1 |
| Initial carbon monoxide conversion (weight %) | 60 | 60 | 60 |
| $H_2$/CO application ratio | 2.1 | 2.1 | 2.1 |
| $H_2$/CO ratio A2 for gaseous effluent from Fischer-Tropsch synthesis (21) | 1.85 | 2.35 | 2.1 |
| $H_2$/CO ratio A1 in supply to Fischer-Tropsch reaction zone (11), immediately after mixing of synthesis gas (3) and recycle (46) | 1.92 | 2.27 | 2.1 |

Figure 4:
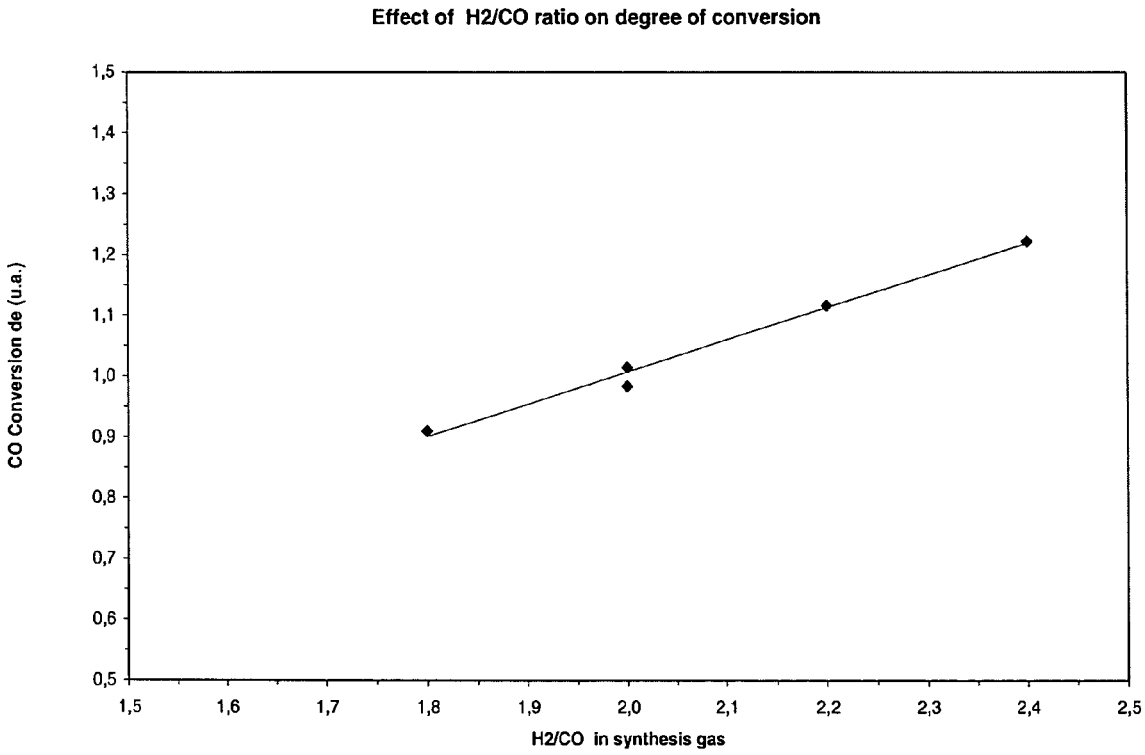
FIG. 4 shows, in the context of the example below, the impact of the molar ratio $H_2/CO$ on carbon monoxide conversion.

Further, FIG. 4 shows the impact of the $H_2$/CO ratio of concentrations on carbon monoxide conversion.

Figure 5:
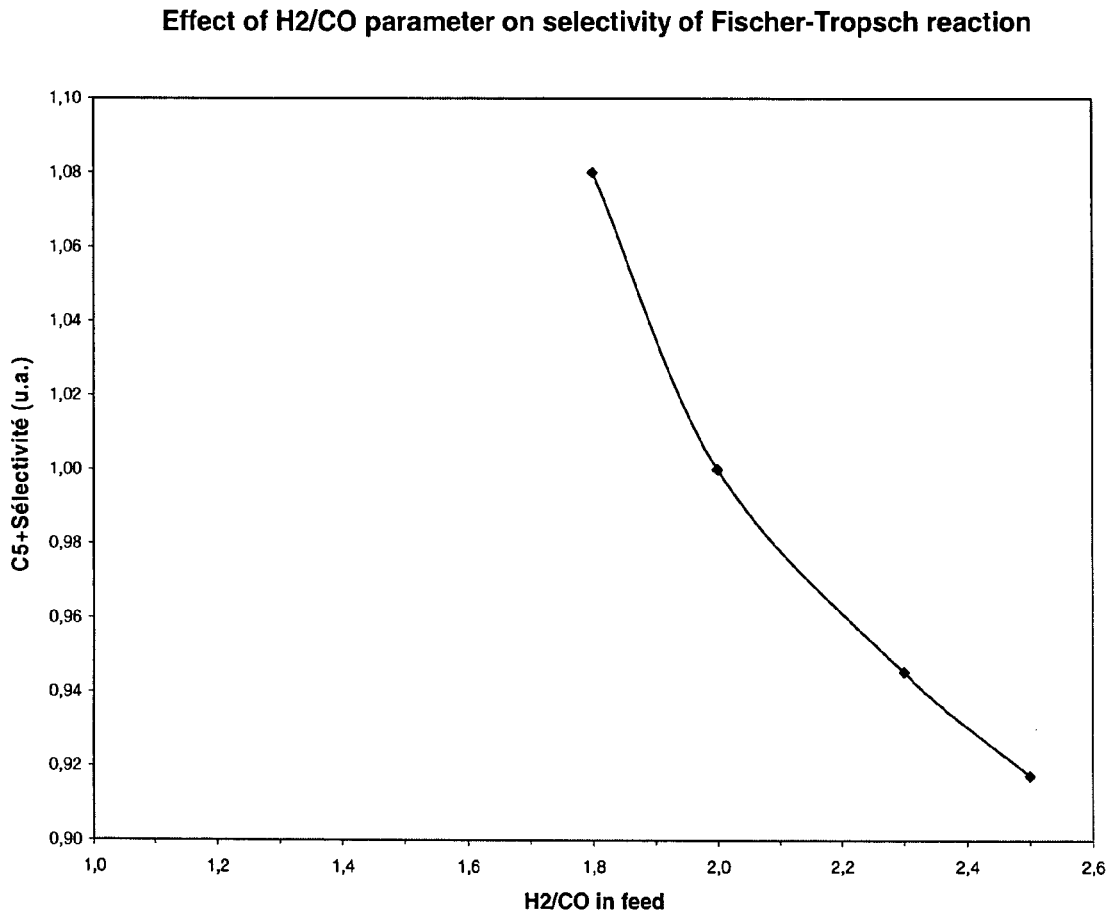
FIG. 5 shows, in the context of the example below, the impact of molar ratio $H_2/CO$ on the selectivity for hydrocarbons containing at least five carbon atoms.

Similarly, FIG. 5 shows the impact of the $H_2$/CO ratio of concentrations on the selectivity for hydrocarbons containing at least five carbon atoms.

In the first case, in which A2<A1, it can be seen that the system changed towards a feed that was less and less hydrogen-rich in a divergent manner, and that the impact on activity or productivity was negative (drop in degree of conversion).

In the second case, in which A2>A1, it can be seen that the system changed towards a feed that was richer and richer in hydrogen in a divergent manner, and that the impact on the reaction selectivity was negative.

In the third case, the function of the unit remained stable and optimized as regards conversion and selectivity is optimized because of the regulation process of the present invention.

In this example, it is possible to conclude that by keeping the ratio of concentrations measured at A1 to a value equal to that measured at A2, stable operation can be obtained, i.e. in which the ratio of $H_2$/CO concentrations is kept constant in the Fischer-Tropsch synthesis reactor.

The regulation process of the invention can not only produce stable operation, but it can simply, rapidly and accurately regulate the ratio of concentrations $H_2$/CO in the reactor to a level that is approximately equal to the application ratio. This operation can thus produce a good compromise between carbon monoxide conversion and selectivity for hydrocarbons containing at least 5 carbon atoms.

The invention claimed is:

1. A process for the production of liquid hydrocarbons by the Fischer-Tropsch process comprising a) for generating a synthesis gas essentially comprising carbon monoxide and hydrogen, b) Fischer-Tropsch synthesis from a supply comprising at least a portion of the synthesis gas, to produce an effluent comprising synthesized liquid hydrocarbons and at least one gaseous effluent, c) condensing the gaseous effluent obtained during b), d) separating the effluent condensed during c) to obtain a gaseous effluent enriched in carbon monoxide and hydrogen, an aqueous phase and liquid hydrocarbons, and e) recycling at least a portion of the enriched gaseous effluent obtained during d) to the Fischer-Tropsch synthesis b), wherein:

1) two molar ratio of concentrations, A1 and A2, are determined between the hydrogen and the carbon monoxide ($H_2$/CO), A1 being the value of said ratio in the supply to the synthesis b), and A2 being the value of said ratio in any of the gaseous effluents obtained during b) to e);

2) comparing ratios A1 and A2; and 3) adjusting the concentrations of hydrogen and/or carbon monoxide in the synthesis gas to keep the difference between the two ratios A1 and A2 substantially constant.

2. A process according to claim 1, in which the ratio of concentrations A2 is calculated on the basis of measurements carried out on:

the gaseous effluent obtained during b);

the cooled effluent obtained during c);

the carbon monoxide- and hydrogen-enriched gaseous effluent obtained during d); or the effluent recycled to Fischer-Tropsch synthesis b).

3. A process according to claim 1, in which the concentrations of hydrogen and/or carbon monoxide in the synthesis gas obtained in a) are adjusted to minimize the difference between the two ratios A 1 and A2.

4. A process according to claim 1, in which the operating conditions are adjusted to adjust the ratio of concentrations $H_2$/CO to a level corresponding to a required application ratio in agreement with an envisaged product distribution.

5. A process according to claim 1, in which the synthesis gas is generated from natural gas.

6. A process according to claim 1, in which a) generating synthesis gas is followed by $a^1$) dedicated to adjusting the concentrations of hydrogen and/or carbon monoxide in the synthesis gas.

7. A process according to claim 6, in which $a^1$) is carried out starting from a supply of a portion of the synthesis gas produced in a) of 1% to 50% by weight of the synthesis gas produced in a).

8. A process according to claim 6, in which $a^1$) comprises the use of a means for extracting hydrogen or carbon monoxide.

9. A process according to claim 8, in which $a^1$) comprises the use of a membrane which extracts hydrogen from a mixture comprising hydrogen and carbon monoxide.

10. A process according to claim 1, in which b) uses one or more slurry bubble column type reactors.

11. A process according to claim 1, in which the catalyst employed in b) comprises cobalt or iron.

12. A process according to claim 1, in which the catalyst used in b) is based on cobalt, the temperature of step b) is in the range from about 200° C. to 250° C., and the pressure in b) is in the range from about 1 to 4 MPa.

* * * * *

UNITED STATES PATENT AND TRADEMARK OFFICE

CERTIFICATE OF CORRECTION

PATENT NO. : 7,776,932 B2
APPLICATION NO. : 11/596848
DATED : August 17, 2010
INVENTOR(S) : Marie-Claire Marion It is certified that error appears in the above-identified patent and that said Letters Patent is hereby corrected as shown below:

Column 9, line 65 reads: "the Fischer-Tropsch process comprising a)for generating a"

Should read: -- the Fischer-Tropsch process comprising a) generating a --

Signed and Sealed this

Twelfth Day of October, 2010

David J. Kappos

David J. Kappos
*Director of the United States Patent and Trademark Office*